United States Patent [19]

Suzuki

[11] Patent Number: 4,983,795

[45] Date of Patent: Jan. 8, 1991

[54] SLIDE SWITCH

[75] Inventor: Masaru Suzuki, Aichi, Japan

[73] Assignee: Kabushiki-Kaisha Tokai-Kika-Denki-Seisakusho, Aichi, Japan

[21] Appl. No.: 330,478

[22] Filed: Mar. 30, 1989

[30] Foreign Application Priority Data

Apr. 7, 1988 [JP] Japan ..... 63-47179[U]

[51] Int. Cl.[5] ..... H01H 15/06

[52] U.S. Cl. ..... 200/550; 200/262

[58] Field of Search ..... 337/140; 200/550, 262, 200/547, 263, 278

[56] References Cited

U.S. PATENT DOCUMENTS

| | | | |
|---|---|---|---|
| 2,182,937 | 12/1939 | Batcheller | 200/550 |
| 2,457,941 | 1/1949 | Szabo | 200/262 |
| 3,242,289 | 3/1966 | Ingwersen | 337/140 |
| 4,172,972 | 10/1979 | Sykora et al. | 200/550 |
| 4,204,104 | 5/1980 | Quigley | 200/550 |
| 4,506,119 | 3/1985 | Tanabe | 200/550 |
| 4,518,943 | 5/1985 | Giessner | 200/573 |

FOREIGN PATENT DOCUMENTS 50-107469 8/1975 Japan .

*Primary Examiner*—Henry J. Recla
*Assistant Examiner*—Glenn T. Barrett
*Attorney, Agent, or Firm*—Venable, Baetjer and Howard

[57] ABSTRACT

Disclosed is a slide switch comprising an insulator, at least one stationary contact member fixed in an upper surface of the insulator, a contact holder slidable on the insulator, movable contact members connected by a connecting member and mounted on the contact holder through contact biasing springs to make sliding electrical contact with the stationary contact member, and a casing enclosing the contact holder together with the insulator. In the slide switch, the movable contact members and the connecting member are formed of a thermally deformable material so that their side walls extending in a direction substantially orthogonal with respect to the upper surface of the contact holder are freely deformable when subjected to heat.

16 Claims, 5 Drawing Sheets

SLIDE SWITCH

BACKGROUND OF THE INVENTION:

1. Field of the Invention

This invention relates to a movable contact member of a slide switch, and more particularly to a slide switch having a structure suitable for preventing undesirable heating of the components of the switch.

2. Description of the Prior Art

A slide switch such as an air control switch is composed of an insulator, at least one conductive stationary contact member fixed in an upper surface of the insulator and defining a boundary between it and the insulator, a contact holder freely slidable on the stationary contact member, and a movable contact member supported on the slidable contact holder through a contact biasing spring and having at least one conductive rivet fixed to it to make sliding electrical contact with the stationary contact member.

When, at the boundary between the insulator and the stationary contact member, the rivet engages the insulator at one of halves of its contact surface and engages the stationary contact member at the other half of its contact surface in a very narrow range, the associated contact surface of the stationary contact member and that of the rivet fixed to the movable contact member is oxidized. In other words, when the contact area between the stationary contact member and the rivet fixed to the movable contact member is very small, the sectional area of the path of electrical current is decreased to increase the electrical resistance, thereby heating the stationary and movable contact members. Also, when the rivet provided on the movable contact member is slightly displaced from the stationary contact member, a spark jumps across the corresponding portions of them, and heat attributable to the spark (Joule heat) is generated. Due to generation of heat from these portions, the functions of the other parts of the switch will be adversely affected by the heat, or the useful service life of the movable or stationary contact member will be shortened.

That is, when the distance of sliding movement of the movable contact member, after the slide switch is turned on, is shortened due to oxidization of the contact surface of the rivet or due to a shortened on-off stroke of the slide switch, the contact resistance increases to increase the electrical resistance, and Joule heat resulting from a voltage drop is generated to heat the movable and stationary contact members. As a result, the contact holder and the insulator may be damaged by fusion or burning.

Undesirable generation of the Joule heat can be prevented by slightly shifting the position of one of the movable and stationary contact members relative to the other. However, in the case of the slide switch which is turned on and off under control of a servo motor, the on-off positions of the movable contact member relative to the position of the stationary contact member are automatically determined. Therefore, even when the electrical contact between the movable and stationary contact members at each of intermediate positions may be ideal, the position where the movable contact member makes electrical contact with the stationary contact member cannot be accurately predicted.

Jp-A-50-107469 describes an electrical contact mechanism of a slide switch in which a stationary contact member is formed of a bimetal so that the contact area of the contact member increases with a temperature rise. However, this slide switch is defective in that, when the switch is used in an environment where the ambient temperature is considerably low, the area of electrical contact between the stationary contact member and its mating movable contact member is very small, resulting in the possibility of generation of heat at the contact area.

SUMMARY OF THE INVENTION

The prior art of slide switches have thus been defective in that, when the movable contact member makes electrical contact with the stationary contact member at the boundary between the stationary contact member and the insulator, abnormal heat tends to be generated at the contact area, thereby adversely thermally affecting the functions of the other parts and shortening the useful service life of the movable and stationary contact members.

With a view to obviate the prior art defects pointed out above, it is an object of the present invention to provide a slide switch which is provided with a heating preventive mechanism capable of preventing heating of the switch components regardless of the position where its movable contact member makes electrical contact with its stationary contact member.

According to one aspect of the present invention which attains the above object, there is provided a slide switch comprising an insulator, at least one stationary contact member fixed in an upper surface of the insulator, a contact holder slidable on the insulator, movable contact members connected by a connecting member and mounted on the contact holder through contact biasing springs to make sliding electrical contact with the stationary contact member, and a casing enclosing the contact holder together with the insulator, wherein the movable contact members and the connecting member are formed of a thermally deformable material so that their side walls extending in a direction substantially orthogonal with respect to the upper surface of the contact holder are freely deformable when subjected to heat.

In the slide switch, the thermally deformable material is a shape memory alloy or a bimetal.

In the slide switch, at least one movable contact member is connected at its side wall to each end of the connecting member at an angle of about 90°, an engaging lug is provided at about the center of the upper end of the connecting member, slide contacts to be opposed by the stationary contact member are mounted on bottom members extending in substantially orthogonal relation from the side walls of the movable contact members respectively, and the contact holder is formed at its lower part with a recess engageable with the engaging lug moving together with the connecting member in the sliding direction and also formed with a channel side wall adapted to abut the side wall of the connecting member to inhibit movement of the connecting member in a direction orthogonal with respect to the sliding direction of the contact holder.

In the slide switch, the connecting member is disposed in the sliding direction of the contact holder and has the movable contact members connected at its respective ends at an angle of about 90° to form a generally U-shaped assembly, and a pair of bottom members extend toward each other from the bottoms of the side walls of the movable contact members.

In a modification of the slide switch, the connecting member is bent to form a central bent portion and a pair of portions connected to the respective ends of the central bent portion at an angle of about 90° and extending in directions opposite to each other, the engaging lug is provided on the central bent portion to extend in a direction orthogonal with respect to the sliding direction of the contact holder, and the movable contact members are connected in substantially orthogonal relation to the respective ends of the connecting member.

In another modification of the slide switch, the movable contact members include two movable contact members having bottom members arranged opposite to each other in an array that is disposed substantially orthogonally with respect to the sliding direction of the contact holder and one movable contact member having a bottom member disposed opposite to the array of the movable contact members in a direction substantially orthogonal with respect to the arrayed direction of the movable contact members, the connecting member connects all of the movable contact members, and the engaging lug is provided on a portion of the connecting member which extends in the sliding direction of the contact holder and separates the two movable contact members forming the array.

In still another modification of the slide switch, the movable contact members include two movable contact members having slide-contact carrying bottom members arranged opposite to each other in that is disposed substantially orthogonally with respect to the sliding direction of the contact holder and one movable contact member having a slide-contact carrying bottom member disposed opposite to the array of the movable contact members in a direction substantially orthogonal with respect to the arrayed direction of the movable contact members, the connecting member connects all of the movable contact members, and the engaging lug is provided on a portion of the connecting member which separates the single movable contact member from the two movable contact members forming the array.

In the slide switch, projections project from the respective ends of the recess formed in the contact holder to engage and hold between them the engaging lug provided on the connecting member.

In the slide switch, an auxiliary member is disposed in close proximity to the free end of the single movable contact member and extends between that end of the movable contact member and the channel side wall of the contact holder in the sliding direction of the contact holder.

According to the present invention, the movable contact members and the connecting member connecting the movable contact members are formed of a thermally deformable material such as a shape memory alloy or a bimetal. Heat is generated at the contact area between the stationary contact member and the slide contacts carried by the movable contact members when the contact area is small, and, due to the temperature rise at the contact area, the side walls of the connecting member and movable contact members are subjected to thermal deformation, with the result that the rate of deformation of these members is amplified. Therefore, the free ends of the movable contact members are urged away from each other to urge the slide contacts away from the stationary contact thereby turning off the slide switch.

Further, because the engaging lug of the connecting member is inserted into and engaged by the recess formed in the contact holder, and the connecting member is held at its center by the engagement between the engaging lug and the recess, further thermal deformation of the connecting member occurs. Also, because the side wall of the connecting member is abutted by the channel side wall of the contact holder, and the connecting member cannot be deformed in a direction orthogonal with respect to the sliding direction of the contact holder, thermal deformation of the movable contact members is concentrated in an unrestricted direction which is the sliding direction of the contact holder, and this amplifies the thermal deformation of the movable contact members in that direction. When the heat is removed, and the temperature at the contact area is restored to the original room temperature, the movable contact members are restored to their original positions on either side of the engaging lug of the connecting member.

Further, because the slide contacts are provided on the bottom members extending at about right angles from the movable contact members, the bottom members themselves are also bent and deformed under influence of heat, and this thermal deformation is amplified by the thermal deformation of the connecting member, thereby reliably urging the slide contacts away from the stationary contact.

According to the present invention, the movable contact members and the connecting member connecting the movable contact members are formed of a thermally deformable material as described above, so that the side walls of these members are deformed when heat is generated at the contact area between the stationary contact and the slide contacts. Therefore, the rate of deformation of the movable contact members is amplified, and the slide contacts are reliably urged away from the stationary contact, thereby reliably turning off the slide switch until the generation of heat is ceased. Thus, damage to the contacts and peripheral members can be prevented.

DETAILED DESCRIPTION OF THE INVENTION:

Preferred embodiments of the slide switch according to the present invention will now be described with reference to FIGS. 1 to 12.

Figure 1:
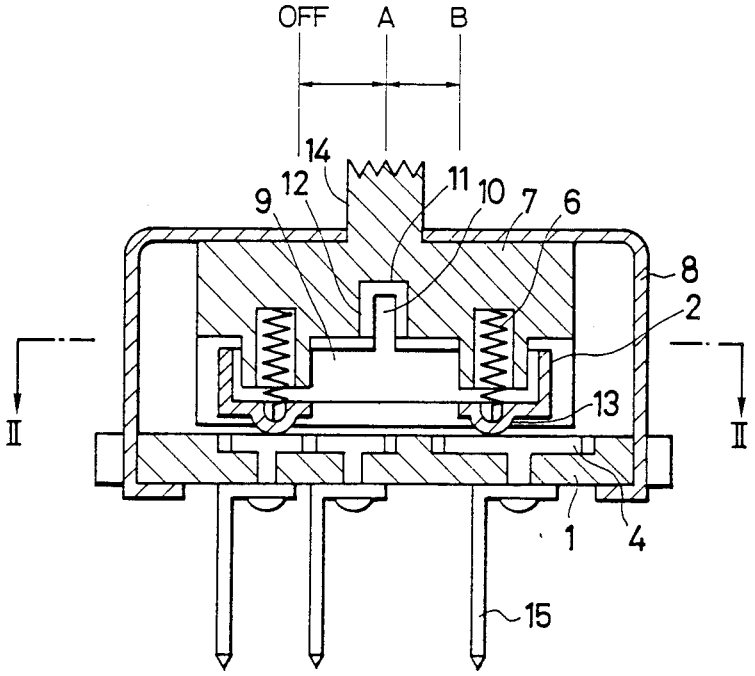
FIG. 1 is a sectional view of a first embodiment of the slide switch according to the present invention.
Figure 2:
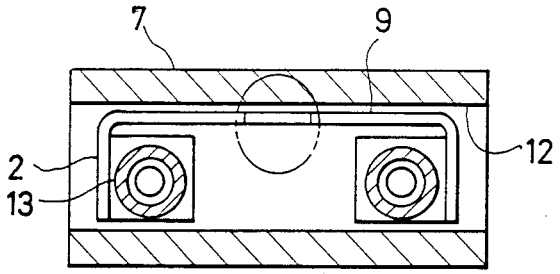
FIG. 2 is a sectional view taken along the line !!in FIG. 1.
Figure 3:
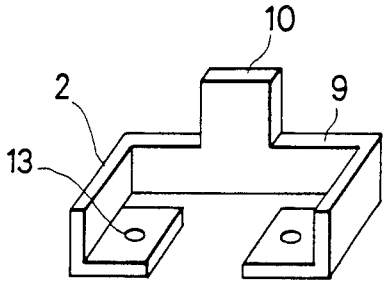
FIG. 3 is a perspective view of the movable contact members and associated members shown in FIG. 1.

Referring to FIGS. 1, 2 and 3 showing a first embodiment of the slide switch according to the present invention, a plurality of stationary contact members 4 are fixed in an upper surface of an insulator 1, and movable contact members 2 making electrical contact with the stationary contact members 4 are mounted on a contact holder 7 through associated contact biasing springs 6. The contact holder 7 is arranged for making sliding movement on the insulator 1 and is housed in a casing 8. In the slide switch, the movable contact members 2 are connected by a connecting member 9, and the movable contact members 2 and the connecting member 9 are formed of a thermally deformable material so that their side walls extending in a direction substantially orthogonal with respect to the upper surface of the insulator 1 are freely deformable when subjected to heat.

An engaging lug 10 is provided at about the center of the upper end of the connecting member 9, and slide contacts 13 are mounted on bottom members extending inwardly from the movable contact members 2 in a direction substantially orthogonal with respect to the extending direction of the side walls of the movable contact members 2 respectively, so that the slide contacts 13 are disposed opposite to the stationary contact members 4. The contact holder 7 is formed in its lower part with a recess 11 into which the engaging lug 10 of the connecting member 9 engages to guide the sliding movement of the movable contact members 2. The contact holder 7 is also formed with a channel or groove side wall 12 which engages the side wall of the connecting member 9 to inhibit movement of the movable contact members 2 in a direction orthogonal with respect to the direction of sliding movement of the movable contact members 2.

A knob 14 provided on the upper surface of the contact holder 7 extends through the top wall of the casing 8 to be connected to a source of sliding power (not shown). The knob 14 driven by the sliding power source slides between a position B and an off position OFF from a middle point A. Terminals 15 are fixed by screw to the lower ends of the stationary contact members 4 respectively. As best shown in FIG. 3, the connecting member 9 is disposed in the sliding direction of the contact holder 7 and has the movable contact members 2 connected to its respective ends at an angle of about 90° to form a generally U-shaped assembly, and a pair of bottom members extend toward each other from the bottoms of the side walls of the movable contact members 2.

Figure 4:
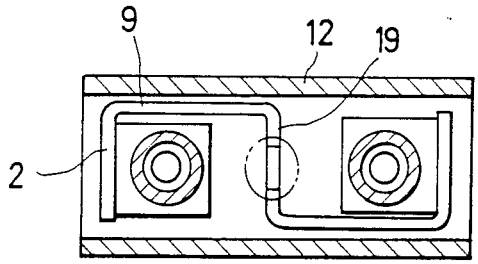
FIGS. 4, 5 and 6 are sectional plan views of part of other embodiments of the present invention.
Figure 7:
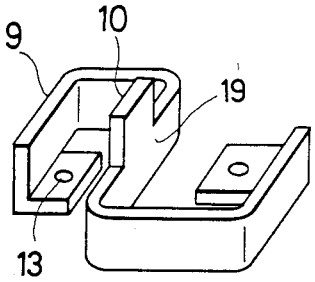
FIGS. 7, 8 and 9 are perspective views of the movable contact members and associated members shown in FIGS. 4, 5 and 6 respectively.

A second embodiment of the present invention is shown in FIGS. 4 and 7. This second embodiment is a partial modification of the first embodiment shown in FIGS. 1 to 3. Referring to FIGS. 4 and 7, the connecting member 9 is bent to form a central bent portion 19 and a pair of portions connected to the respective ends of the central bent portion 19 at an angle of about 90° and extending in directions opposite to each other. The engaging lug 10 is provided on the central bent portion 19 to extend in a direction orthogonal with respect to the direction of sliding movement of the contact holder 7, and the movable contact members 2 are connected in substantially orthogonal relation to the respective ends of the connecting member 9.

Figure 5:
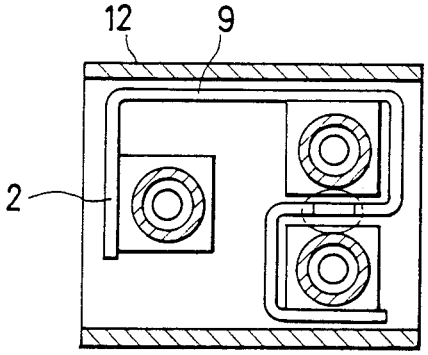
Figure 8:
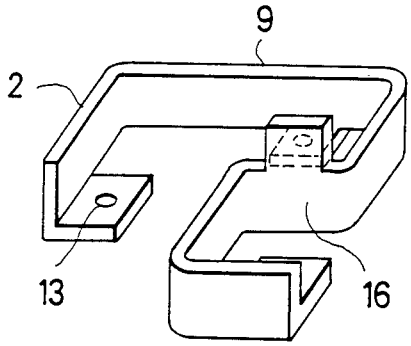

A third embodiment of the present invention is shown in FIGS. 5 and 8. This third embodiment is also a partial modification of the first embodiment shown in FIGS. 1 to 3. Referring to FIGS. 5 and 8, the movable contact members 2 include two movable contact members 2 having bottom members arranged opposite to each other in an array that is disposed substantially orthogonally with respect to the direction of sliding movement of the contact holder and one movable contact member 2 having a bottom member disposed opposite to the array of the movable contact members 2 in a direction substantially orthogonal with respect to the arrayed direction of the movable contact members 2. The connecting member 9 connects all of these movable contact members 2, and the engaging lug 10 is provided on a portion of the connecting member 9 which extends in the direction of sliding movement of the contact holder 7 and separates the two movable contact members 2 forming the array.

Figure 6:
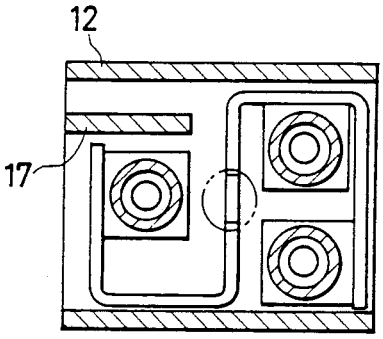
Figure 9:
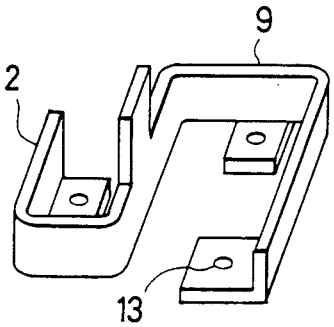

A fourth embodiment of the present invention is shown in FIGS. 6 and 9. This fourth embodiment is also a partial modification of the first embodiment shown in FIGS. 1 to 3. Referring to FIGS. 6 and 9, the movable contact members 2 include two movable contact members 2 having bottom members arranged opposite to each other in an array that is disposed substantially orthogonally with respect to the direction of sliding movement of the contact holder 7 and one movable contact member 2 having bottom member disposed opposite to the array of the movable contact members 2 in a direction substantially orthogonal with respect to the arrayed direction of the movable contact members 2. The connecting member 9 connects all of these movable contact members 2, and the engaging lug 10 is provided on a portion of the connecting member 9 which separates the single movable contact member 2 from the two movable contact members 2 forming the array. An auxiliary member 17 is disposed in close proximity to the free end of the single movable contact member 2 and extends between that end of the single movable contact member 2 and the channel or groove side wall 12 of the contact holder 7 in the direction of sliding movement of the contact holder 7.

The operation of the first embodiment of the slide switch of the present invention will now be described with reference to FIG. 10.

Figure 10:
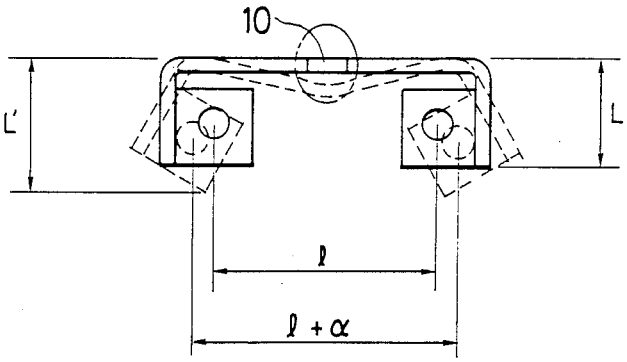
FIG. 10 illustrates the operation of the first embodiment shown in FIGS. 1 to 3.

When heat is generated as a result of the electrical contact between the slide contacts 13 and the stationary contact members 4, and, as a result, the connecting member 9 and the movable contact members 2 are heated, the portions of the connecting member 9 and the movable contact members 2 on both sides of the engaging lug 10 are deformed around the engaging lug 10 as shown by dotted lines in FIG. 10. In this case, the length L′ of each of the heated movable contact members 2 does not appreciably change from the original length measured at the room temperature. However, because the le between the connecting member 9 and the movable contact member 2 on either side of the engaging lug 10 exceeds 90° with the deformation of the connecting member 9, the original contact-to-contact distance l measured at the room temperature increases to (l+a) when heat is applied. As a result, the slide contacts 13 having made electrical contact with the stationary contact members 4 are now moved away from the stationary contact members 4, and the slide switch is turned off. Suppose, for example, that the slide switch is an air control switch which is turned on-off by a servo motor to control the amount of air delivered from a blower. When the air control switch is turned off, the amount of air delivered from the blower decreases, and, due to other control factors, the movable contact members 2 slide toward and onto the stationary contact members 4 to turn on the air control switch again. In the above description, a bimetal is used as the thermally deformable material, and a material having a large coefficient of linear expansion is used to form the wall surface of channel center side (the inner surface) of the contact holder 7. However, any other thermally deformable material such as a shape memory alloy may be used. According to the first embodiment, the movable contact members 2 can make free sliding movement without being obstructed, and both the movable contact members 2 and the connecting member 9 are freely deformable. Because the connecting member 9 connecting the movable contact members 2 cannot make movement in a direction orthogonal with respect to the sliding direction of the contact holder 7 by being restricted by the channel side wall surface of the contact holder 7, the deformation of the connecting member 9 in the sliding direction is further intensified or amplified to further increase the rate of deformation c, so that the slide contacts 13 can be reliably urged away from their on positions. Because, at the same time, the connecting member 9 is deformed in the same horizontal plane, the resistance against deformation due to, for example, its weight is not large, and the slide contacts 13 can be smoothly parted from the stationary contact members 4.

Figure 11:
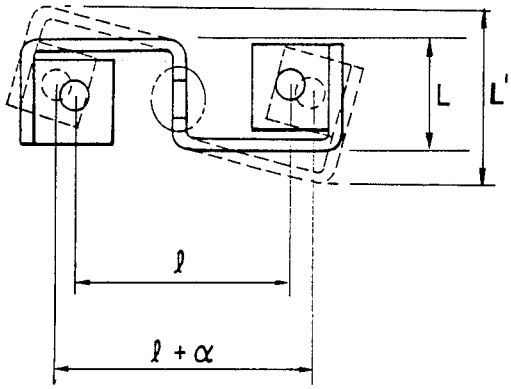
FIG. 11 illustrates the operation of the second embodiment shown in FIG. 4.

The operation of the second embodiment of the slide switch will now be described with reference to FIG. 11.

In the second embodiment, the engaging lug 10 is provided at substantially the center of the central bent portion of the connecting member 9 connecting the two movable contact members 2, and the two movable contact members 2 are connected at about 90° angles to the connecting member 9 on either side of the engaging lug 10. Therefore, the rate of deformation a of the movable contact members 2 tends to become larger. Thus, in the second embodiment, bending and deformation of the members located opposite to the stationary contact members 4 are added to further improve the effect of deformation.

Figure 12:
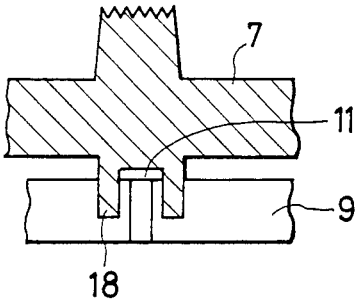
FIG. 12 is a sectional view of part of another embodiment of the present invention.

FIG. 12 shows part of a fourth embodiment of the present invention in which the structure of the recess 11 formed in the contact holder 7 shown in FIG. 1 is modified. Referring to FIG. 12, projections 18 project from the respective ends of the recess 11 to engage and hold the engaging lug 10 between them. The structure shown in FIG. 12 is advantageous in that the thickness of the remaining portion of the contact holder 7 can be decreased.

What is claimed is:

1. A slide switch comprising an insulator, at least one stationary contact member fixed on an upper surface of said insulator, a contact holder slidable on said insulator, a plurality of movable contact members mounted on said contact holder through a contact biasing spring respectively to make sliding electrical contact with said stationary contact member, a connecting member having ends mountable to respective said movable contact members to connect said movable contact members to each other, a casing enclosing said contact holder, said movable contact members comprising side walls and at least one bottom member disposed substantially orthogonally in relation to respective said side walls, wherein said movable contact members and said connecting member are formed of shape memory alloy so that the side walls of said movable contact members and said connecting member extending substantially orthogonally with respect to said upper surface of said insulator are freely deformable once subjected to heat.

2. A slide switch according to claim 1, wherein at least one movable contact member is connected at a side wall thereof to each of said ends of said connecting member at an angle of about 90°, an engaging lug being provided along an upper surface of said connecting member that is disposed adjacent said contact holder, said engaging lug being disposed generally centrally on an upper surface of said connecting member, a plurality of slide contacts opposed by said stationary contact member being mounted on said bottom members so as to extend substantially orthogonally relative to lower surfaces of the side walls of said movable contact members, said contact holder having a lower surface disposed adjacent said connecting member that is formed with a recess engageable with said engaging lug such that said contact holder moves together with said connecting member in the sliding direction, said contact holder being formed with a groove side wall adapted to abut said connecting member to inhibit movement of said connecting member in a direction orthogonal with respect to the sliding direction of said contact holder.

3. A slide switch according to claim 1, wherein said connecting member comprises a pair of bottom members and is disposed in the sliding direction of said contact holder, said movable contact members being, connected to respective ends of said connecting member at an angle of about 90° to form a generally U-shaped assembly from which said bottom members extend toward each other from a lower surface of the side walls of said movable contact members.

4. A slide switch according to claim 1, wherein said connecting member is bent to form a central bent portion having a pair of portions extending respectively from said central bent portion at an angle of about 90° and extending in directions opposite to each other, an engaging lug being provided on said central bent portion which extends in a direction orthogonal with respect to the sliding direction of said contact holder, and said movable contact members are connected in substantially orthogonal relation to respective ends of said connecting member.

5. A slide switch according to claim 1, wherein said movable contact members comprise two movable contact members having bottom members arranged opposite to each other in an array that is disposed substantially orthogonally with respect to the sliding direction of said contact holder, one movable contact member having a bottom member disposed opposite to the array of said movable contact members in a direction that is substantially orthogonal with respect to the array of said movable contact members, said connecting member connecting all of said movable contact members, and an engaging lug provided on a portion of said connecting member which extends in the sliding direction of said contact holder and separates said two movable contact members forming the array.

6. A slide switch according to claim 1, wherein said movable contact members comprise two movable contact members having bottom members arranged opposite to each other in an array that is disposed substantially orthogonally with respect to the sliding direction of said contact holder, one movable contact member having a bottom member disposed opposite to the array of said movable contact members in a direction that is substantially orthogonal with respect to the array of said movable contact members, said connecting member connecting all of said movable contact members, and an engaging lug provided on a portion of said connecting member which separates said single movable contact member from said two movable contact members forming the array.

7. A slide switch according to claim 6, wherein an auxiliary member of said contact holder is disposed in close proximity to said single movable contact member and extends between said movable contact member and said groove side wall of said contact holder in the sliding direction of said contact holder.

8. A slide switch according to claim 18, wherein said contact holder is formed with at least one recess, said recess comprising a plurality of projections to engage and hold therebetween an engaging lug provided on said connecting member.

9. A slide switch comprising an insulator, at least one stationary contact member fixed on an upper surface of said insulator, a contact holder slidable on said insulator, a plurality of movable contact members mounted on said contact holder through a contact biasing spring to make sliding electrical contact with said stationary contact member, a connecting member having ends mountable to respective said movable contact members to connect said movable contact members to each other, and a casing enclosing said contact holder, said movable contact members comprising side walls and at least one bottom member disposed substantially orthogonally in relation to respective said side walls, wherein said movable contact members and said connecting member are formed of a bimetal so that the side walls of said movable contact members and said connecting member extending substantially orthogonally with respect to said upper surface of said insulator are freely deformable once subjected to heat.

10. A slide switch according to claim 9, wherein at least one movable contact member is connected at a side wall thereof to each of said ends of said connecting member at an angle of about 909°, an engaging lug being provided along an upper surface of said connecting member that is disposed adjacent said contact holder, said engaging lug being disposed generally centrally on an upper surface of said connecting member, a plurality of slide contacts opposed by said stationary contact member being mounted on said bottom members so as to extend substantially orthogonally relative to lower surfaces of the side walls of said movable contact members, said contact holder having a lower surface disposed adjacent said connecting member that is formed with a recess engageable with said engaging lug such that said contact holder moves together with said connecting member in the sliding direction, said contact holder being formed with a groove side wall adapted to abut said connecting member to inhibit movement of said connecting member in a direction orthogonal with respect to the sliding direction of said contact holder.

11. A slide switch according to claim 9, wherein said connecting member comprises a pair of bottom members and is disposed with said contact holder in the sliding direction of said contact holder, said movable contact members being connected to respective ends of said connecting member at an angle of about 90° to form a generally U-shaped assembly from which said bottom members extend toward each other from a lower surface of the side walls of said movable contact members.

12. A slide switch according to claim 9, wherein said connecting member is bent to form a central bent portion having a pair of portions extending respectively from said central bent portion at an angle of about 90° and extending in directions opposite to each other, an engaging lug being provided on said central bent portion which extends in a direction orthogonal with respect to the sliding direction of said contact holder, and said movable contact members are connected in substantially orthogonal relation to respective ends of said connecting member.

13. A slide switch according to claim 9, wherein said movable contact members comprise two movable contact members having bottom members arranged opposite to each other in an array that is disposed substantially orthogonally with respect to the sliding direction of said contact holder, one movable contact member having a bottom member disposed opposite to the array of said movable contact members in a direction that is substantially orthogonal with respect to the array of said movable contact members, said connecting member connecting all of said movable contact members, and an engaging lug provided on a portion of said connecting member which extends in the sliding direction of said contact holder and separates said two movable contact members forming the array.

14. A slide switch according to claim 9, wherein said movable contact members comprise two movable contact members having bottom members arranged opposite to each other in an array that is disposed substantially orthogonally with respect to the sliding direction of said contact holder, one movable contact member having a bottom member disposed opposite to the array of said movable contact members in a direction that is substantially orthogonal with respect to the array of said movable contact members, said connecting member connects all of said movable contact members, and an engaging lug provided on a portion of said connecting member which separates said single movable contact member from said two movable contact members forming the array.

15. A slide switch according to claim 14, wherein an auxiliary member of said contact holder is disposed in close proximity to said single movable contact member and extends between said movable contact member and said groove side wall of said contact holder in the sliding direction of said contact holder.

16. A slide switch according to claim 19, wherein said contact holder is formed with at least one recess, said recess comprising a plurality of projections to engage and hold therebetween an engaging lug provided on said connecting member.

* * * * *